United States Patent [19]

Steinel et al.

[11] Patent Number: 4,642,158

[45] Date of Patent: Feb. 10, 1987

[54] HOT GLUE PISTOL

[75] Inventors: Heinrich W. Steinel, Herzebrock; Hans Siwon, Obing, both of Fed. Rep. of Germany

[73] Assignee: Steinel GmbH & Co., K.G., Fed. Rep. of Germany

[21] Appl. No.: 703,930

[22] Filed: Feb. 21, 1985

[30] Foreign Application Priority Data

Feb. 29, 1984 [EP] European Pat. Off. ..... 84102136.3

[51] Int. Cl.[4] ..... B67D 5/62

[52] U.S. Cl. ..... 156/497; 156/499; 156/574; 156/578; 156/579; 222/146.2; 222/146.5; 401/2

[58] Field of Search ..... 156/497, 500, 509, 574, 156/578, 579, 499; 401/1, 2, 140; 222/146.2, 146.5

[56] References Cited

U.S. PATENT DOCUMENTS

| | | | |
|---|---|---|---|
| Re. 24,801 | 3/1960 | Kaminsky | 156/497 |
| 2,372,737 | 4/1945 | Philips, Jr. | 156/574 |
| 3,204,828 | 9/1965 | Paulsen | 222/146.5 |
| 3,658,627 | 4/1972 | Kaminsky | 156/497 |
| 3,660,206 | 5/1972 | Ortel | 156/558 |
| 4,090,643 | 5/1978 | Wilkinson, Jr. et al. | 222/146.5 |
| 4,407,692 | 10/1983 | Torbeck | 156/579 |
| 4,601,597 | 7/1986 | Bertram et al. | 401/1 |

*Primary Examiner*—Michael Wityshyn
*Attorney, Agent, or Firm*—Darby & Darby

[57] ABSTRACT

A hot glue pistol for melting and dispensing a hot melt glue (3) comprises a hot air blower (6) for heating the bonding location, the hot air flow simultaneously acting as the heat source for melting the glue.

15 Claims, 5 Drawing Figures

HOT GLUE PISTOL

DESCRIPTION

Figure 1:
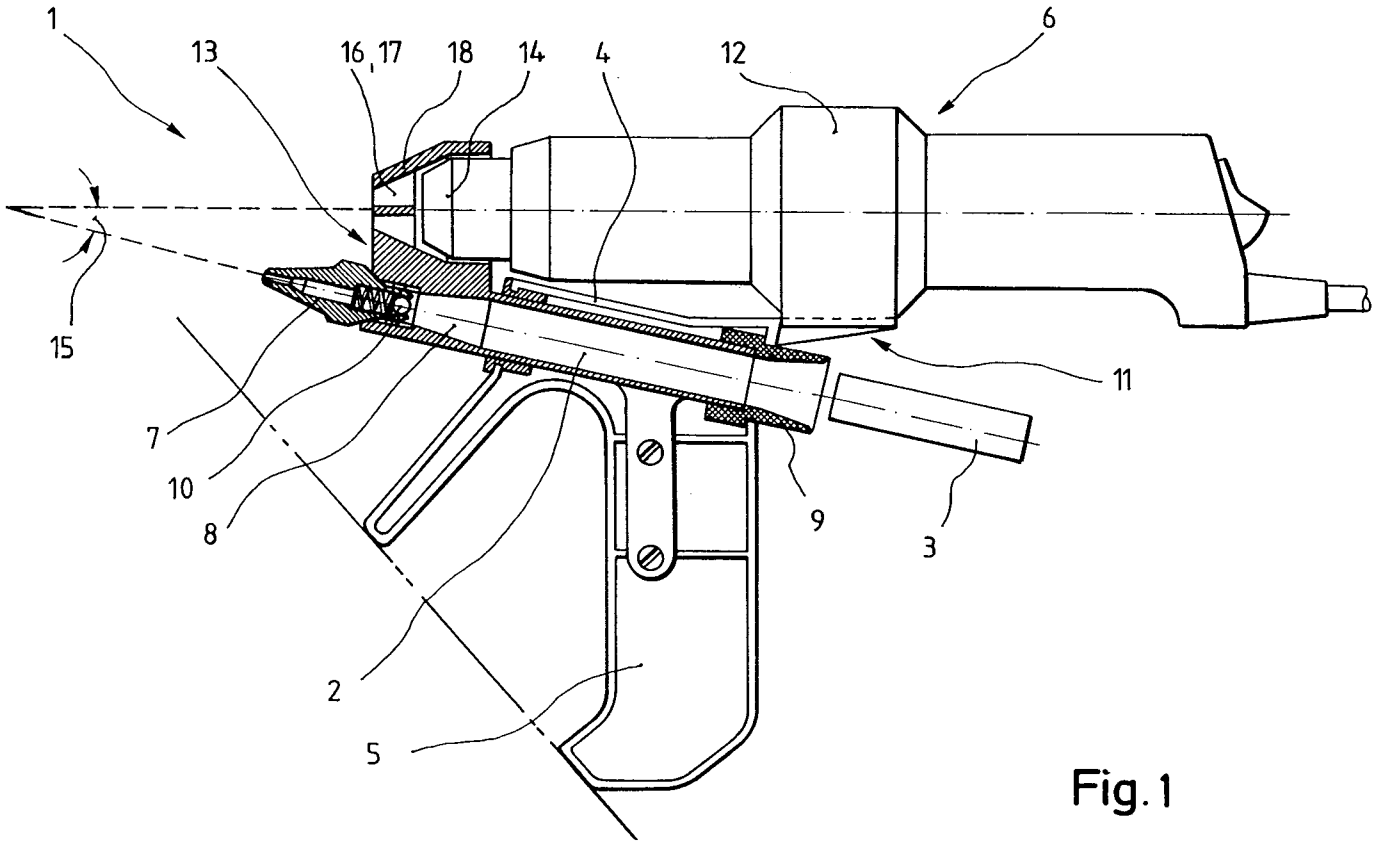

The present invention relates to a hot glue pistol for melting and dispensing a hot melt glue, comprising a guide channel for the glue to be melted, a dispenser nozzle at one end of the guide channel, and heating means for melting the glue.

Known from practical use are hot glue pistols of the type defined above, in which electric heating means is employed in the form of heater cartridges disposed in the body of the pistol parallel to the guide channel. Although hot glue pistols of this type are very useful for many applications, there is sometimes the disadvantage that the materials to be bonded is solely heated via the glue itself. Particularly in the case of materials having a high heat capacity and/or thermal conductivity the glue tends to solidify very quickly, so that an optimum bond is not obtained.

It is an object of the present invention to improve a hot glue pistol of the type defined in the introduction in a simple manner, so that glued bonds can be readily obtained by a single operator handling the device.

This object is attained by the characterizing features of claim 1.

As the hot glue pistol according to the invention is handled in the conventional manner, the glue is molten and applied onto the surfaces to be bonded, the hot air blower simultaneously directing a flow of heated air onto the surfaces to be bonded. As a result, these surfaces are heated, so that the glue applied thereto solidifies less rapidly and there is sufficient time for it to wet the surfaces to be bonded. However, the heat transfer means is effective to extract the amount of heat required for melting the glue from the hot air produced by the hot air blower and to transfer it to the guide channel. This means that the conventional heating device for melting the glue is no longer required.

The hot air blower is advantageously releasably attached to the hot glue pistol, so that replacement and/or repair thereof is considerably facilitated in comparison to prior art glue pistols, and that the hot air blower may be used independently of the hot glue pistol, if so desired.

In an advantageous embodiment, the hot air blower is releasably attached to the outer portion of the hot glue pistol by means of a dovetail guide. An even weight distribution with a view to effortless handling of the hot glue pistol is advantageously obtained by respectively locating the dovetail groove and tongue at the end portion of the hot glue pistol opposite the dispenser nozzle, and at an intermediate position longitudinally of the hot air blower. To this effect the dovetail groove or tongue is advantageously located on the upper surface of the hot glue pistol opposite the grip handle thereof.

For obtaining a reliable connection the dovetail guide may advantageously be formed with its width diminishing towards the dispenser nozzle and the outlet end.

According to a specific embodiment of the invention the axes of the dispenser nozzle of the guide channel and the outlet end of the hot air blower converge at an acute angle having a magnitude of about 5° to 30°.

The heat transfer means is advantageously located adjacent the outlet end of the hot air blower. A particularly simple and effective heat transfer is obtained by forming the heat transfer means with a lamellar structure projecting into the hot air zone. The lamellar structure is advantageously formed with parallel laminae. It is also possible, however, to employ a lamellar structure having laminae in an intersecting or grid-shaped arrangement. Particularly advantageous is an arrangement in which the laminae extend substantially in the longitudinal direction of the hot air zone. It is also possible, however, to align the laminae transversely, so that they additionally function as a baffle arrangement.

According to a further aspect of the invention, the lamellar structure is surrounded by a sleeve element also receiving the outlet end of the hot air blower.

A particularly effective heat transfer is obtained by an embodiment in which the heat transfer means is integrally formed with the guide channel and/or the dispenser nozzle.

For enabling the temperature of the glue in the guide channel to be controlled, the lamellar structure is advantageously mounted in such a manner that it can at least partially be swung out of the hot air zone. In this context it is also advantageous to form the heat transfer means or the lamellar structure as a replaceable unit.

According to a further advantageous aspect, the heat transfer means may act as a support for the hot air blower.

Figure 2:
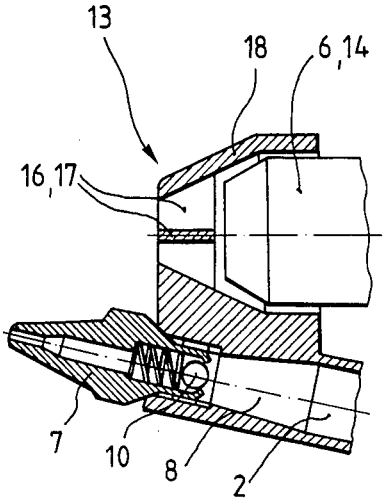
Figure 3:
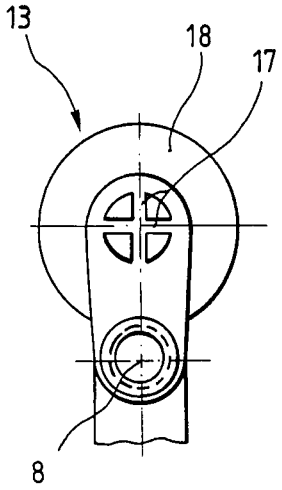
Figure 4:
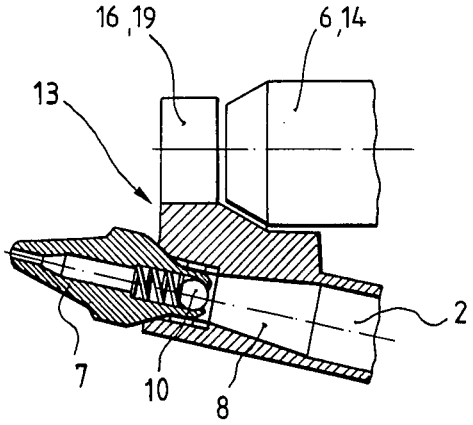
Figure 5:
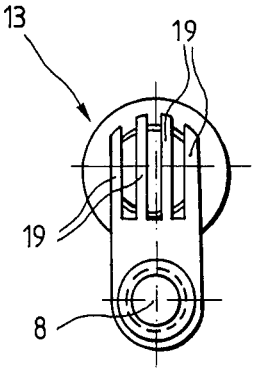

Two embodiments of the invention shall now be described by way of example with reference to the accompanying drawings, wherein:

FIG. 1 shows a partially sectioned sideview of a hot glue pistol according to one embodiment of the invention, FIG. 2 shows a partially sectioned sideview of the outlet end portion of the hot glue pistol shown in FIG. 1, FIG. 3 shows a front end view of the outlet end portion shown in FIG. 2, although without the dispenser nozzle, FIG. 4 shows a partially sectioned sideview of the outlet end portion according to another embodiment, and FIG. 5 shows a front end view of the outlet end portion shown in FIG. 4, although without the dispenser nozzle.

FIG. 1 shows a first embodiment of a hot glue pistol 1 according to the invention, comprising a guide channel 2 for a hot melt glue 3 contained in a pistol housing 4 having a grip handle 5, and an electric hot air blower 6.

A dispenser nozzle 7 for the molten glue 3 is threaded into or otherwise releasably secured to the free end of an end portion 8 of guide channel 2 projecting from pistol housing 4. Connected to the opposite end of guide channel 2 is a rearwardly diverging inlet bushing 9 wherethrough the glue is supplied in solid state in the form of a rod. For avoiding unintentional outflow of the molten glue 3 through dispenser nozzle 7, guide channel 2 is provided with a non-return ball valve 10 designed to be opened by a predetermined pressure acting thereon in the direction towards dispenser nozzle 7.

Hot air blower 6 is releasably attached to the upper surface of pistol housing 4 opposite grip handle 5 by means of a dovetail guide 11 (shown diagrammatically). In the present embodiment one part of dovetail guide 11, viz. the dovetail groove, is formed at the end of pistol housing 4 opposite dispense nozzle 7, while the dovetail tongue is formed at an intermediate portion 12 longitudinally of hot air blower 6.

A heat transfer means 13 is integrally formed with end portion 8 of guide channel 2 so as to simultaneously act as a support for the outlet end 14 of hot air blower 6. Guide channel 2 including dispenser nozzle 7 and hot air blower 6 including its outlet end portion 14 are disposed at inclined positions relative to one another with their free ends converging at an acute angle 15 of about 12° in the present example.

Heat transfer means 13 includes a lamellar structure 16 projecting into the hot air flow discharged from the outlet end 14 of hot air blower 6, i.e. disposed outside of the hot air blower.

As shown in FIGS. 2 and 3, lamellar structure 13 comprises crosswise intersecting laminae 17 surrounded by a sleeve element 18 also receiving outlet end 14 of hot air blower 6. A portion of sleeve element 18 and outlet end 14 is formed as a jet nozzle.

In the embodiment shown in FIGS. 4 and 5, lamellar structure 16 consists of substantially parallel laminae 19 projecting into the hot air flow discharged from outlet end 14. Hot air blower 6 and guide channel 2 are disposed in a common plane, so that the imaginary extensions of their converging axes intersect at an intersection point. Laminae 17 and 19 extend in this plane, or parallel thereto, i.e. in the longitudinal direction of the hot air flow. The free end of heat transfer means 13 is rearwardly offset with respect to the free end of dispenser nozzle 7.

The hot glue pistol according to the invention operates as follows:

A glue rod 3 is inserted through inlet bushing 9 into guide channel 2. The glue is advanced along guide channel 2 towards dispenser nozzle 7 by inserting a sequence of glue rods 3 and pushing them forwards with the thumb. The hot air blower 6 is energized to produce a flow of hot air which is discharged through lamellar structure 16, whereby laminae 17, or 19, respectively, are heated, so that the heat absorbed thereby is transferred to end portion 8 of guide channel 2 and dispenser nozzle 7. As the glue rod 3 first inserted into guide channel 2 approaches end portion 8 it is successively molten, and the molten glue is discharged through dispenser nozzle 7. The exertion of a suitable pressure on the glue rod 3 projecting rearwards from inlet bushing 9 causes ball valve 10 to open so as to permit the molten glue to be discharged.

What is claimed is:

1. A hot glue pistol for melting and dispensing a hot melt glue, said pistol being of the type including a guide channel for the glue to be melted, a dispenser nozzle at one end of said guide channel, heating means in the form of a hot air blower for melting said glue, the hot air blower having a hot air tube with an outlet defining a discharge end of said hot air blower located adjacent said dispenser nozzle, and heat transfer means connected to at least one of said guide channel and said dispenser nozzle and projecting into the hot air flow produced by said hot air blower, the improvement comprising said heat transfer means being disposed substantially entirely outside said hot air blower and being positioned downstream of the discharge end thereof in a position in which it is fully exposed to the hot air flow therefrom.

2. A hot glue pistol according to claim 1, characterized in that said hot air blower is releasably attached to said hot glue pistol.

3. A hot glue pistol according to claim 2, characterized in that said hot air blower is releasably attached to an outer portion of said hot glue pistol by a dovetail guide having a groove and tongue.

4. A hot glue pistol according to claim 3, characterized in that one portion of said dovetail guide is located at the end portion of said hot melt pistol opposite the dispenser nozzle, and another portion of said dovetail guide is at an intermediate location longitudinally of said hot air blower.

5. A hot glue pistol according to claim 3 including a handle, the groove or tongue of said dovetail guide being disposed at an upper surface of said hot glue pistol opposite to the handle thereof.

6. A hot glue pistol according to claim 1, characterized in that said dispenser nozzle of said guide channel and said outlet end of said hot air blower converge at an acute angle towards their downstream ends.

7. A hot glue pistol according to claim 6, characterized in that said acute angle is of a magnitude of about 5° to 30°.

8. A hot glue pistol according to claim 1, characterized in that said heat transfer means comprises a lamellar structure projecting into the hot air flow.

9. A hot glue pistol according to claim 8, characterized in that said lamellar structure comprises substantially parallel laminae.

10. A hot glue pistol according to claim 8, characterized in that said lamellar structure comprises laminae disposed in one of an intersecting arrangement and a grid-shaped arrangement.

11. A hot glue pistol according to claim 9 or 10, characterized in that said laminae extend substantially in the longitudinal direction of the hot air zone.

12. A hot glue pistol according to claim 8, characterized in that said laminae are surrounded by a sleeve element receiving the outlet end of said hot air blower.

13. A hot glue pistol according to claim 8, characterized in that said lamellar structure is mounted for pivotal movement at least partially out of the hot air zone.

14. A hot glue pistol according to claim 1, characterized in that the entire heat transfer means is formed as a replaceable unit.

15. A hot glue pistol according to claim 8, characterized in that the lamellar structure is formed as a replaceable unit.

* * * * *